US010851614B2

(12) United States Patent
Kellner et al.

(10) Patent No.: US 10,851,614 B2
(45) Date of Patent: Dec. 1, 2020

(54) SLIP ASSEMBLY FOR A DOWNHOLE TOOL

(71) Applicant: INNOVEX DOWNHOLE SOLUTIONS, INC., Houston, TX (US)

(72) Inventors: Justin Kellner, Adkins, TX (US); Danny Matthews, Houston, TX (US)

(73) Assignee: INNOVEX DOWNHOLE SOLUTIONS, INC., Houston, TX (US)

( * ) Notice: Subject to any disclaimer, the term of this patent is extended or adjusted under 35 U.S.C. 154(b) by 60 days.

(21) Appl. No.: 16/213,595

(22) Filed: Dec. 7, 2018

(65) Prior Publication Data

US 2020/0182011 A1 Jun. 11, 2020

(51) Int. Cl.
*E21B 33/129* (2006.01)

(52) U.S. Cl.
CPC ..... *E21B 33/1291* (2013.01)

(58) Field of Classification Search
CPC ..... E21B 33/129; E21B 33/1293; E21B 33/1291; Y10T 29/4979
See application file for complete search history.

(56) References Cited

U.S. PATENT DOCUMENTS 2,153,035 A * 4/1939 Burt ..... E21B 19/10 29/413
2,687,775 A * 8/1954 Baker ..... E21B 23/04 166/63
8,066,065 B2 * 11/2011 Buckner ..... E21B 33/1204 166/118
9,157,288 B2 10/2015 Martinez
9,845,658 B1 * 12/2017 Nish ..... E21B 23/06
2007/0102165 A1 * 5/2007 Slup ..... E21B 33/129 166/387
2014/0224477 A1 * 8/2014 Wiese ..... E21B 33/1291 166/179
2014/0262344 A1 * 9/2014 Standridge ..... E21B 33/134 166/382
2016/0145957 A1 * 5/2016 Davies ..... E21B 23/01 166/382
2018/0179850 A1 * 6/2018 Hou ..... C08K 7/20
2019/0063178 A1 * 2/2019 Frazier ..... E21B 34/063

* cited by examiner

*Primary Examiner* — Kipp C Wallace
(74) *Attorney, Agent, or Firm* — MH2 Technology Law Group LLP

(57) ABSTRACT

A slip assembly includes a first segment, a second segment that is circumferentially offset from the first segment, and a connector positioned circumferentially between the first and second segments. The connector couples the first and second segments together, and wherein a length of the connector is from about 50% to about 100% of a length of the first segment.

18 Claims, 4 Drawing Sheets

SLIP ASSEMBLY FOR A DOWNHOLE TOOL

BACKGROUND

Packers, bridge plugs, frac plugs, and other downhole tools may be deployed into a wellbore and set in place to isolate two zones from one another in the wellbore. Generally, such setting is accomplished using a system of slip assemblies and cones. A setting tool is used to axially compress the slip assemblies and cones along a mandrel. The slip assemblies may include a plurality of circumferentially offset segments that are coupled together. As the slip assemblies ride up the tapered surfaces of the cones during axial compression, the radial outward force on the slip assemblies may cause the segments to break apart from one another. The segments may then move farther in the radial outward direction and into engagement with a surrounding tubular (e.g., a casing or the wellbore wall itself). This causes the segments to bite into the surrounding tubular, thereby holding the downhole tool in place. However, oftentimes, a pressure of a fluid between the cones and the slip assemblies may exert a force on the slip assemblies in a radially outward direction, which may cause the segments of the segments to break apart prematurely.

SUMMARY

Embodiments of the disclosure may provide a slip assembly that includes a first segment, a second segment that is circumferentially offset from the first segment, and a connector positioned circumferentially between the first and second segments. The connector couples the first and second segments together, and wherein a length of the connector is from about 50% to about 100% of a length of the first segment.

Embodiments of the disclosure may also provide a slip assembly including a plurality of segments that are circumferentially offset from one another. Each segment includes a first axial end and a second axial end. A thickness of the first axial end of each segment is greater than a thickness of the second axial end of each segment. The slip assembly also includes a connector positioned between a first of the segments and a second of the segments. A length of the connector is from about 50% to about 100% of a length of the first segment, and the connector is configured to break in response to a predetermined axial compression force.

Embodiments of the disclosure may further provide a slip assembly including a plurality of segments that are circumferentially offset from one another. Each segment includes a first axial end and a second axial end, a thickness of the first axial end of each segment is greater than a thickness of the second axial end of each segment, and an outer surface of a first of the segments defines a plurality of openings that are configured to at least partially receive inserts. The slip assembly also includes a connector positioned between the first segment and a second of the segments. The first segment, the second segment, and the connector are a monolithic component made at least partially of a phenolic material or magnesium, a length of the connector is from about 90% to about 100% of a length of the first segment, an outer surface of the connector is substantially flat and recessed from outer surfaces of the first and second segments by a first distance, an inner surface of the connector is curved and recessed from inner surfaces of the first and segments by a second distance, the first distance is less than the second distance, and a thickness of the connector is substantially constant proceeding in an axial direction.

BRIEF DESCRIPTION OF THE DRAWINGS

The present disclosure may best be understood by referring to the following description and accompanying drawings that are used to illustrate embodiments of the invention. In the drawings.

DETAILED DESCRIPTION

Figure 1:
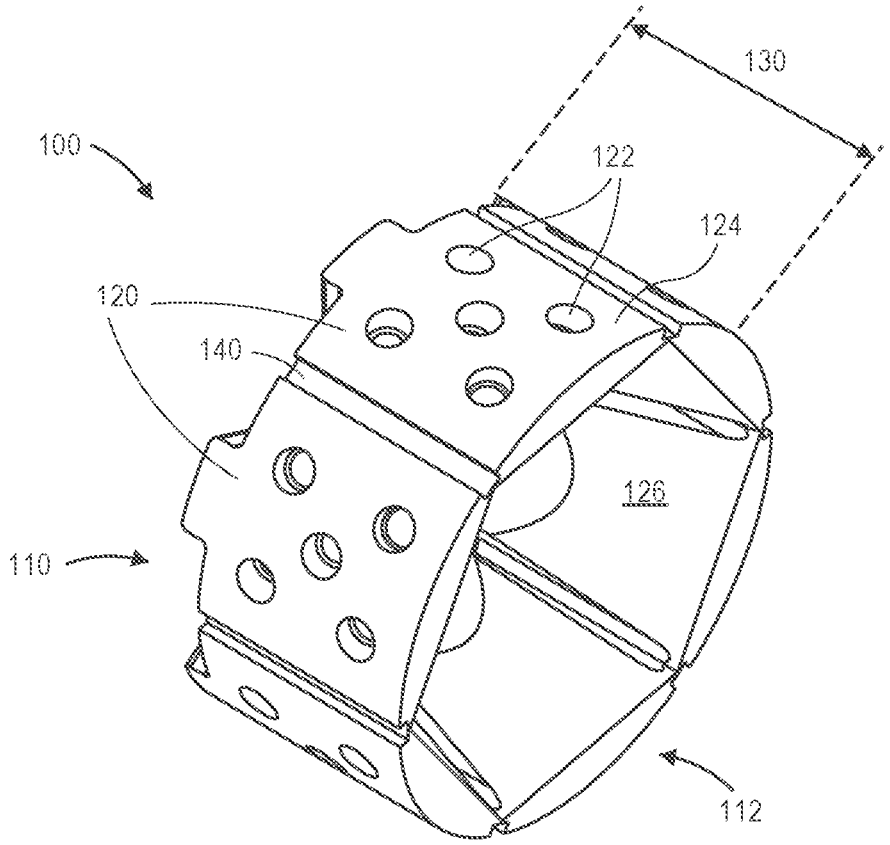
FIG. 1 illustrates a perspective view of a slip assembly, according to an embodiment.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

In general, embodiments of the present disclosure may provide a slip assembly for a downhole tool. The downhole tool may be or include a packer, a bridge plug, a frac plug, or the like. The slip assembly may include a plurality of segments that are circumferentially offset from one another. Each circumferentially adjacent pair of segments may be coupled together by a connector or "web." The connector may extend axially along a length that is from about 50% to about 100% of the axial length of the segments. As described in greater detail below, the design of the connector may allow the connector to break apart by axial compression of the slip assembly against a cone when the downhole tool is in a desired location (e.g., in a wellbore). However, the design of the connector may prevent the connector from breaking apart prematurely (e.g., before the axial compression).

FIG. 1 illustrates a perspective view of a slip assembly 100, according to an embodiment. The slip assembly 100 may be used in, or otherwise a part of, a downhole tool such as a packer, a bridge plug, a frac plug, or the like, without limitation. The slip assembly 100 may be made of a composite material. For example, the composite material may be or include a fiber-reinforced material such as a phenolic material. In another embodiment, the slip assembly 100 may be made of a metallic material. For example, the slip assembly 100 may be made of magnesium which may be configured to degrade of dissolve in a predictable manner in a wellbore environment.

The slip assembly 100 may be annular and include a first axial end 110 and a second axial end 112. A length 130 of the slip assembly 100 may be defined between the first and second ends 110, 112 (e.g., excluding castellations of the slip assembly 100, if present, as shown). The length 130 of the slip assembly 100 is shown more clearly in FIG. 4. The slip assembly 100 may also include a plurality of segments (six are shown: 120) that are circumferentially offset from one another. It will be appreciated that any number of segments 120 may be included in various embodiments of the slip assembly 100.

Each pair of circumferentially adjacent segments 120 may be coupled/held together by a connector or "web" (six are shown: 140). The connectors 140 may extend a majority of the length 130 of the slip assembly 100. For example, a length of the connectors 140 may be from about 50% to about 100% of the length 130 of the slip assembly 100, about 60% to about 100% of the length 130 of the slip assembly 100, about 70% to about 100% of the length 130 of the slip assembly 100, about 80% to about 100% of the length 130 of the slip assembly 100, about 90% to about 100% of the length 130 of the slip assembly 100, or about 100% of the length 130 of the slip assembly 100.

Although a single connector 140 is shown coupling each pair of circumferentially adjacent segments 120, in other embodiments, a plurality of connectors 140 may be used to couple each pair of circumferentially adjacent segments 120, such that two or more connectors 140 may be axially offset from one another. In this embodiment, the aggregate length of the connectors 140 used to couple each pair of circumferentially adjacent segments 120 may fall within the range (s) provided above, and/or one of the connectors 140 may be in the disclosed range of axial length, and the other may be smaller.

Having the connectors 140 extend a majority of the length of the slip assembly 100 may reduce the likelihood that the connectors 140 will break prematurely. This may help to prevent the segments 120 from separating from one another (e.g., in a wellbore) before the downhole tool is in the desired location and ready to be set. In particular, the connectors 140 may prevent the axial end of the slip assembly 100 from bending outward or "flowering" during the run-in process. By comparison, some conventional slip assemblies that include a bridge between adjacent slips only at an axial end may allow for such flowering, which is considered to cause premature setting of downhole tools in the well. Furthermore, the present slip assembly 100 design may have a design that is more efficient to mill from a cast blank.

The slip assembly 100 may also define a plurality of holes 122. For example, each segment 120 may have a plurality of holes 122 extending radially therethrough (i.e., from an outer radial surface 124 to an inner radial surface 126). In another embodiment, the holes 122 may extend only partially radially therethrough (i.e., from the outer radial surface 124 toward, but not all the way to, the inner radial surface 126). In at least one embodiment, the depth of the holes 122 may vary. For example, the holes 122 proximate to the first axial end 110 may be deeper than the holes 122 proximate to the second axial end 112, or vice versa.

Although not shown, the holes 122 may be configured to receive inserts, which are sometimes referred to as "buttons." Such inserts may be formed from material (e.g., carbide) that is harder than the material of the slip assembly 100. The inserts may thus bite (e.g., partially embed) into the surrounding tubular when the slip assembly 100 is set. The holes 122 and the inserts may be oriented at angles to resist the slip assembly 100 losing gripping force and being displaced from engagement with the surrounding tubular when the pressure differential across the downhole tool reverses.

Figure 2:
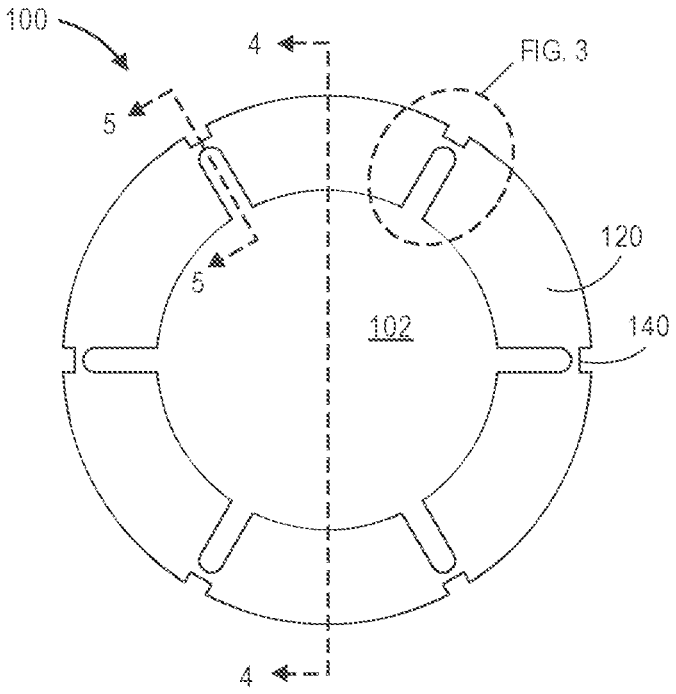
FIG. 2 illustrates an axial end view of the slip assembly, according to an embodiment.
Figure 3:
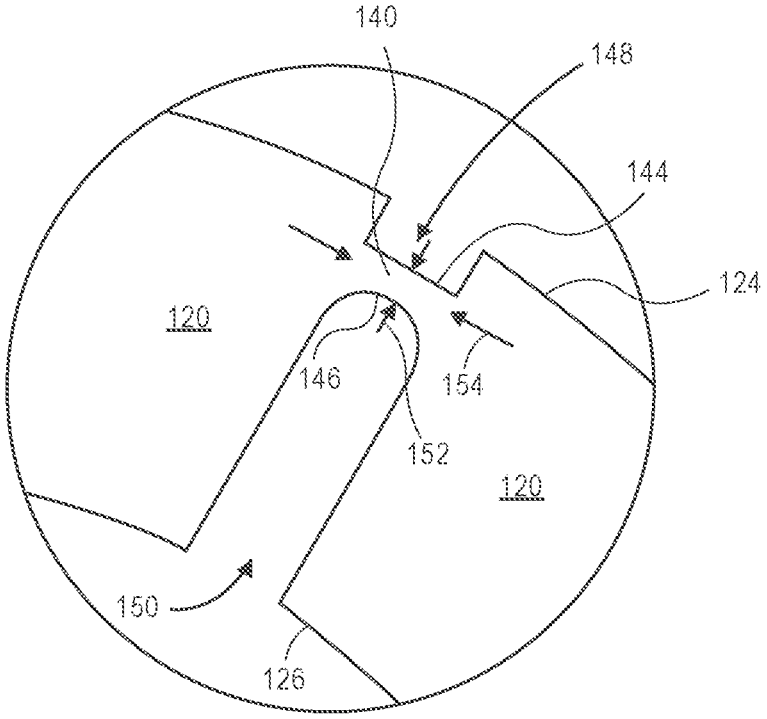
FIG. 3 illustrates an enlarged view of a portion of the slip assembly shown in FIG. 2, according to an embodiment.

FIG. 2 illustrates an axial end view of the slip assembly 100, and FIG. 3 illustrates an enlarged view of a portion of FIG. 2, according to an embodiment. As mentioned above, the slip assembly 100 may be annular and thus define an axial bore 102. In at least one embodiment, the slip assembly 100 may be a single (e.g., integral, unitary, monolithic, etc.) component made/cast from the same material (e.g., magnesium or another metal, or a phenolic composite material, etc.). Thus, as noted above, the connectors 140 may be made of the same material as the segments 120.

In at least one embodiment, the connectors 140 may be formed by removing material from the slip assembly 100 between two circumferentially adjacent segments 120. The material may be removed by machining, milling, grinding, scraping, etc. At least a portion of the material may be removed proceeding radially-inwardly (e.g., using a first tool) such that outer surfaces 144 of the connectors 140 are recessed with respect to outer surfaces 124 of the adjacent segments 120. The end of the first tool may be flat such that the outer surfaces 144 of the connectors 140 may be substantially flat. The depth of the radially-inwardly extending recesses 148 may be from about 0.08 inches to about 0.12 inches or from about 0.094 inches to about 0.099 inches.

At least a portion of the material may also or instead be removed proceeding radially-outwardly (e.g., using a second tool) such that inner surfaces 146 of the connectors 140 are recessed with respect to inner surfaces 126 of the adjacent segments 120. The end of the second tool may be curved such that the inner surfaces 146 of the connectors 140 may also be curved. The depth of the radially-outwardly extending recesses 150 may be from about 0.3 inches to about 0.8 inches or about 0.4 inches to about 0.7 inches.

Due to the curved inner surfaces 146 of the connectors 140, a thickness 152 of each connector 140 may vary proceeding in a circumferential direction. For example, the thickness 152 of the connectors 140 may be at a minimum value at a circumferential midpoint of each connector 140, and the thickness 152 may increase proceeding circumferentially away from the midpoint in one or both circumferential directions. A width 154 of the connectors 140 may be substantially equal to a width of the recesses 148 and/or the recesses 150. The width 154 may be from about 0.15 inches to about 0.25 inches or about 0.17 inches to about 0.21 inches.

Figure 4:
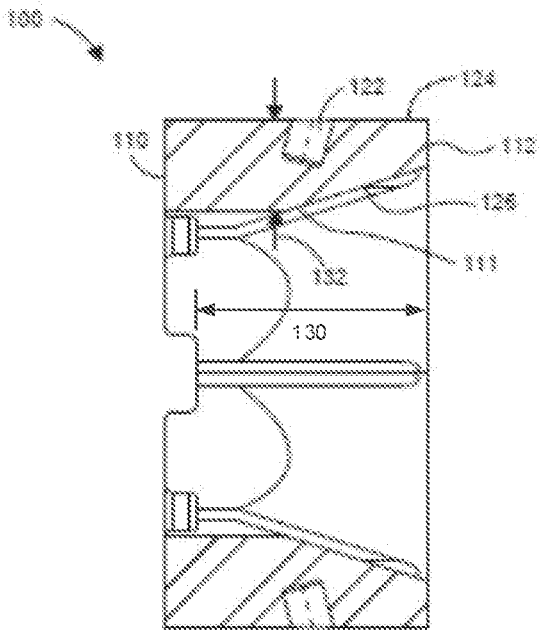
FIG. 4 illustrates a cross-sectional view of the slip assembly taken through line 4-4 in FIG. 2, according to an embodiment.

FIG. 4 illustrates a cross-sectional view of the slip assembly 100 taken through line 4-4 in FIG. 2, according to an embodiment. As mentioned above, the length 130 of the slip assembly 100 may be defined between the first and second ends 110, 112. The length 130 may be from about 1.75 inches to about 2.75 inches or from about 2.0 inches to about 2.3 inches.

A thickness 132 of the segments 120 (i.e., between the outer surface 124 and the inner surface 126) may vary proceeding from the first end 110 to the second end 112. As shown, the thickness 132 may remain substantially constant from the first end 110 proceeding axially to an intermediate point 111. Thus, a (e.g., radial) distance between a central longitudinal axis of the slip assembly 100 and the inner surface 126 may remain substantially constant from the first end 110 proceeding axially to the intermediate point 111. The thickness 132 may then decrease from the intermediate point 111 proceeding axially to the second end 112. Thus, the distance between the central longitudinal axis of the slip assembly 100 and the inner surface 126 may increase from the intermediate point 111 proceeding axially to the second end 112.

Figure 5:
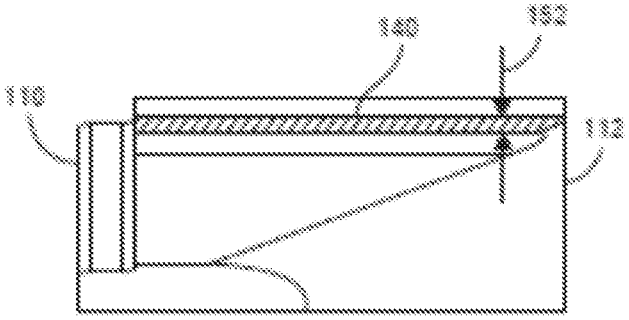
FIG. 5 illustrates a cross-sectional view of the slip assembly taken through line 5-5 in FIG. 2, according to an embodiment.

FIG. 5 illustrates a cross-sectional view of the slip assembly 100 taken through line 5-5 in FIG. 2, according to an embodiment. As shown, the thickness 152 of the connector 140 may be substantially constant proceeding in an axial direction (i.e., between the first and second ends 110, 112 of the slip assembly 100), even though the thickness 132 of the segments 120 may vary. For example, the (e.g., minimum value of the) thickness 152 of the connectors 140 may be from about 0.01 inches to about 0.1 inches, about 0.01 inches to about 0.075 inches, or 0.01 inches to about 0.06 inches.

In at least one embodiment, the thickness 152 of the connectors 140 may depend at least partially on the material from which the slip assembly 100 is made. For example, if the slip assembly 100 is made of metal (e.g., magnesium), the thickness 152 of the connectors 140 may be toward the lower end of the ranges provided above (e.g., from about 0.01 inches to about 0.03 inches). If the slip assembly 100 is made from a composite material (e.g., phenol), the thickness 152 of the connectors 140 may be toward the upper end of the ranges provided above (e.g., from about 0.05 inches to about 0.08 inches).

Figure 6:
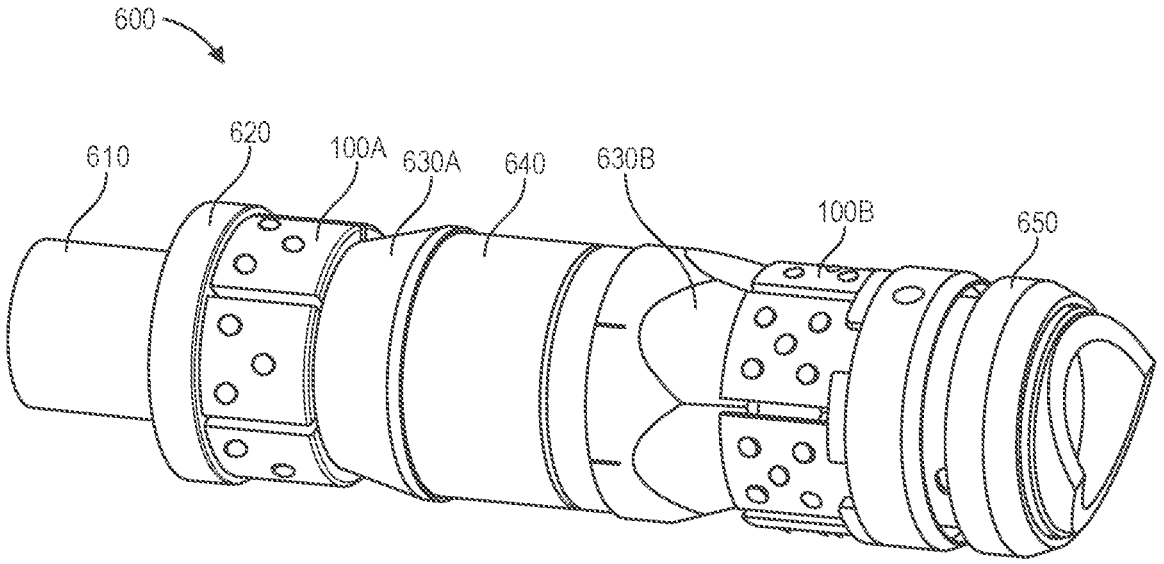
FIG. 6 illustrates a perspective view of a downhole tool (e.g., a plug) including the slip assembly, according to an embodiment.

FIG. 6 illustrates a perspective view of a downhole tool (e.g., a plug) 600 including two slip assemblies 100A, 100B, according to an embodiment. The downhole tool 600 may include a mandrel 610. One or more components may be positioned at least partially around the mandrel 610 and/or coupled to the mandrel 610. In the example shown, the components may include a load ring 620, the first and second slip assemblies 100A, 100B, first and second cones 630A, 630B, one or more sealing elements 640, and a shoulder or shoe 650.

The downhole tool 600 may be actuated from a run-in state to a set state by a setting tool (e.g., a wireline adapter kit). When the downhole tool 600 is actuated, the mandrel 610 is held stationary and/or pulled in a first (e.g., uphole) direction, while the load ring 620 is pushed in a second (e.g., downhole) direction. This causes the load ring 620 to move with respect to the mandrel 610. As a result, the first and second slip assemblies 100A, 100B, the first and second cones 630A, 630B, and/or the sealing element 640 may be axially-compressed between the load ring 620 and the shoulder or shoe 650. The axial compression may cause the slip assemblies 100A, 100B to slide up the tapered outer surfaces of the cones 630A, 630B, which may exert a radially outward force on the slip assemblies 100A, 100B. When this force exceeds a predetermined amount, the connectors 140 break, causing the segments 120 to separate from one another, as discussed above.

As used herein, the terms "inner" and "outer"; "up" and "down"; "upper" and "lower"; "upward" and "downward"; "above" and "below"; "inward" and "outward"; "uphole" and "downhole"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A slip assembly, comprising:

a first segment;

a second segment that is circumferentially offset from the first segment, wherein a thickness of the first segment and a thickness of the second segment vary proceeding in an axial direction; and a connector positioned circumferentially between the first and second segments, wherein the connector couples the first and second segments together, wherein the connector comprises first and second portions having a gap defined axially therebetween, wherein a thickness of the connector is substantially constant proceeding in the axial direction, and wherein a length of the connector is from 70% to 100% of a length of the first segment.

2. The slip assembly of claim 1, wherein the length of the connector is from 90% to 100% of the length of the first segment.

3. The slip assembly of claim 1, wherein the first segment, the second segment, and the connector are a monolithic component cast from a phenolic material or a metallic material.

4. The slip assembly of claim 1, wherein an outer surface of the connector is recessed with respect to outer surfaces of the first and second segments.

5. The slip assembly of claim 1, wherein an inner surface of the connector is recessed with respect to inner surfaces of the first and second segments.

6. The slip assembly of claim 1, wherein the thickness of the connector varies proceeding in a circumferential direction.

7. The slip assembly of claim 1, wherein the first segment, the second segment, and the connector are made at least partially from a metallic material, and wherein the thickness of the connector is from 0.01 inches to 0.03 inches.

8. The slip assembly of claim 1, wherein the first segment, the second segment, and the connector are made at least partially from a composite material, and wherein the thickness of the connector is from 0.05 inches to 0.08 inches.

9. The slip assembly of claim 1, wherein the thickness of the first segment is substantially constant from a first axial end thereof to an intermediate point, and wherein the thickness of the first segment decreases from the intermediate point to a second axial end thereof.

10. A slip assembly, comprising:

a plurality of segments that are circumferentially offset from one another, wherein each segment comprises a first axial end and a second axial end, and wherein a thickness of the first axial end of each segment is greater than a thickness of the second axial end of each segment; and a connector positioned between a first of the segments and a second of the segments, wherein the connector comprises first and second portions having a gap defined axially-therebetween, wherein a thickness of the connector is substantially constant proceeding in an axial direction, wherein a length of the connector is from 70% to 100% of a length of the first segment, and wherein the connector is configured to break in response to a predetermined axial compression force.

11. The slip assembly of claim 10, wherein the length of the connector is from 90% to 100% of the length of the first segment.

12. The slip assembly of claim 10, wherein an outer surface of the first segment defines a plurality of openings that are configured to at least partially receive inserts therein, wherein a first of the openings is closer to the first axial end than a second of the openings, and wherein a depth of the first opening is greater than a depth of the second opening.

13. The slip assembly of claim 10, wherein the first segment, the second segment, and the connector are a monolithic component made at least partially of a phenolic material or magnesium.

14. The slip assembly of claim 10, wherein an outer surface of the connector is recessed from outer surfaces of the first and second segments by a first distance, wherein an inner surface of the connector is recessed from inner surfaces of the first and segments by a second distance, and wherein the first distance is less than the second distance.

15. The slip assembly of claim 14, wherein the outer surface of the connector is substantially flat, and wherein the inner surface of the connector is curved.

16. The slip assembly of claim 10, wherein the thickness of the connector varies proceeding in a circumferential direction.

17. The slip assembly of claim 16, wherein the thickness of the connector has a minimum value proximate to a circumferential midpoint of the connector, and wherein the thickness of the connector increases proceeding circumferentially in both directions from the circumferential midpoint.

18. A slip assembly, comprising:

a plurality of segments that are circumferentially offset from one another, wherein:

each segment comprises a first axial end and a second axial end, a thickness of the first axial end of each segment is greater than a thickness of the second axial end of each segment, and an outer surface of a first of the segments defines a plurality of openings that are configured to at least partially receive inserts, and a connector positioned between the first segment and a second of the segments, wherein:

the first segment, the second segment, and the connector are a monolithic component made at least partially of a phenolic material or magnesium, the connector comprises first and second portions having a gap defined axially-therebetween, a length of the connector is from 70% to 100% of a length of the first segment, an outer surface of the connector is substantially flat and recessed from outer surfaces of the first and second segments by a first distance, an inner surface of the connector is curved and recessed from inner surfaces of the first and segments by a second distance, the first distance is less than the second distance, and a thickness of the connector is substantially constant proceeding in an axial direction.

* * * * *